US011288916B2

(12) United States Patent
Coon et al.

(10) Patent No.: US 11,288,916 B2
(45) Date of Patent: Mar. 29, 2022

(54) MULTI-TIERED USER INTERFACE FOR A GAMING MACHINE

(71) Applicant: SG Gaming, Inc., Las Vegas, NV (US)

(72) Inventors: Robert Coon, Chicago, IL (US); Christian Kulujian, Chicago, IL (US); Paul Lesley, Chicago, IL (US)

(73) Assignee: SG Gaming, Inc., Las Vegas, NV (US)

( * ) Notice: Subject to any disclaimer, the term of this patent is extended or adjusted under 35 U.S.C. 154(b) by 141 days.

(21) Appl. No.: 16/878,270

(22) Filed: May 19, 2020

(65) Prior Publication Data

US 2021/0366231 A1 Nov. 25, 2021

(51) Int. Cl.
*G07F 17/32* (2006.01)
*G07F 17/42* (2006.01)

(52) U.S. Cl.
CPC ..... *G07F 17/3216* (2013.01); *G07F 17/3209* (2013.01); *G07F 17/3213* (2013.01); *G07F 17/3239* (2013.01); *G07F 17/42* (2013.01)

(58) Field of Classification Search
CPC ..... G07F 17/3216; G07F 17/3209; G07F 17/3213; G07F 17/3239; G07F 17/42
See application file for complete search history.

(56) References Cited

U.S. PATENT DOCUMENTS

D406,865 S 3/1999 Heidel
6,334,612 B1 1/2002 Wurz et al.
D459,402 S 6/2002 Wurz et al.
D464,377 S 10/2002 Wurz et al.
D495,754 S 9/2004 Wurz et al.
D495,755 S 9/2004 Wurz et al.
D508,268 S 8/2005 Hanchar et al.
D509,254 S 9/2005 Rasmussen et al.
D512,105 S 11/2005 Chitrapongse et al.
D539,854 S 4/2007 Luciano et al.
D549,785 S 8/2007 Luciano, Jr. et al.
D564,600 S 3/2008 Greenberg et al.
D564,601 S 3/2008 Strahinic et al.
D566,197 S 4/2008 Greenberg et al.
D572,314 S 7/2008 Vellejo et al.
D577,077 S 9/2008 Mitchell et al.
D579,500 S 10/2008 Luciano, Jr. et al.
RE40,625 E 1/2009 Wurz et al.
RE40,671 E 3/2009 Wurz et al.
D595,783 S 7/2009 Anderson
D596,678 S 7/2009 Myers
D597,144 S 7/2009 Myers
D599,858 S 9/2009 Lesley et al.
D599,859 S 9/2009 Lesley et al.
D599,860 S 9/2009 Lesley et al.
D604,368 S 11/2009 Lesley et al.
D613,802 S 4/2010 Meyers et al.
D622,780 S 8/2010 Lesley et al.
(Continued)

*Primary Examiner* — Kevin Y Kim

(57) ABSTRACT

A gaming machine comprises a cabinet, a display device coupled to the cabinet, a control unit housed within the cabinet, and a multi-tiered user interface coupled to the cabinet. The control unit is configured to direct the display device to display a wagering game. The user interface includes lower and upper tiers disposed at respective lower and upper elevations. The upper tier at least partially overhangs the lower tier. The lower and upper tiers bear respective first and second types of input devices for operating the wagering game.

18 Claims, 7 Drawing Sheets

(56) References Cited

U.S. PATENT DOCUMENTS

| | | | | |
|---|---|---|---|---|
| D622,781 | S | 8/2010 | Lesley et al. | |
| D622,782 | S | 8/2010 | Chudek et al. | |
| D646,336 | S | 10/2011 | Kelly et al. | |
| D646,337 | S | 10/2011 | Kelly et al. | |
| D678,955 | S | 3/2013 | Lesley et al. | |
| D678,956 | S | 3/2013 | Lesley et al. | |
| D678,957 | S | 3/2013 | Cesaroni et al. | |
| D678,958 | S | 3/2013 | Cesaroni et al. | |
| D681,130 | S | 4/2013 | Lesley et al. | |
| D682,948 | S | 5/2013 | Cesaroni et al. | |
| D685,033 | S | 6/2013 | Wudtke | |
| D691,665 | S | 10/2013 | Chudek | |
| D691,666 | S | 10/2013 | Lesley et al. | |
| D697,558 | S | 1/2014 | Myers et al. | |
| D704,273 | S | 5/2014 | Chudek | |
| D704,275 | S | 5/2014 | Lesley et al. | |
| D706,359 | S | 6/2014 | Wudtke | |
| D706,741 | S | 6/2014 | Myers | |
| D712,975 | S | 9/2014 | Lesley et al. | |
| D714,392 | S | 9/2014 | Arabian | |
| D714,875 | S | 10/2014 | Wudtke et al. | |
| D715,364 | S | 10/2014 | Wudtke et al. | |
| D729,321 | S | 5/2015 | Arabian | |
| D740,888 | S | 10/2015 | DePalma et al. | |
| D742,974 | S | 11/2015 | Lesley et al. | |
| D742,975 | S | 11/2015 | Myers et al. | |
| RE46,169 | E | 10/2016 | Kelly et al. | |
| D808,354 | S | 1/2018 | Castro et al. | |
| D812,146 | S | 3/2018 | Castro et al. | |
| D812,147 | S | 3/2018 | Castro et al. | |
| D812,148 | S | 3/2018 | Castro et al. | |
| D812,149 | S | 3/2018 | Castro et al. | |
| D819,747 | S | 6/2018 | Castro et al. | |
| D832,355 | S | 10/2018 | Castro et al. | |
| D832,356 | S | 10/2018 | Castro et al. | |
| D832,357 | S | 10/2018 | Castro et al. | |
| D832,358 | S | 10/2018 | Castro et al. | |
| D836,164 | S | 12/2018 | Castro et al. | |
| D842,933 | S | 3/2019 | Castro et al. | |
| D843,458 | S | 3/2019 | Castro et al. | |
| D843,459 | S | 3/2019 | Castro et al. | |
| D843,460 | S | 3/2019 | Castro et al. | |
| D843,461 | S | 3/2019 | Castro et al. | |
| D843,462 | S | 3/2019 | Castro et al. | |
| D843,463 | S | 3/2019 | Castro et al. | |
| D843,464 | S | 3/2019 | Castro et al. | |
| D843,465 | S | 3/2019 | Castro et al. | |
| D843,466 | S | 3/2019 | Castro et al. | |
| D843,474 | S | 3/2019 | Lesley et al. | |
| D843,475 | S | 3/2019 | Lesley et al. | |
| D843,476 | S | 3/2019 | Lesley et al. | |
| D843,477 | S | 3/2019 | Lesley et al. | |
| D843,478 | S | 3/2019 | Lesley et al. | |
| D843,479 | S | 3/2019 | Castro et al. | |
| D843,480 | S | 3/2019 | Castro et al. | |
| D844,062 | S | 3/2019 | Lesley et al. | |
| D871,506 | S | 12/2019 | Castro et al. | |
| 10,521,999 | B1* | 12/2019 | Itkis | A47B 5/04 |
| D872,188 | S | 1/2020 | Bernard et al. | |
| D872,189 | S | 1/2020 | Bernard et al. | |
| D873,921 | S | 1/2020 | Bernard et al. | |
| D877,811 | S | 3/2020 | Bernard et al. | |
| D878,477 | S | 3/2020 | Bernard et al. | |
| D880,608 | S | 4/2020 | Glenn, II et al. | |
| D880,609 | S | 4/2020 | Bernard et al. | |
| D880,610 | S | 4/2020 | Glenn, II et al. | |
| D880,611 | S | 4/2020 | Glenn, II et al. | |
| D880,612 | S | 4/2020 | Bernard et al. | |
| D880,613 | S | 4/2020 | Bernard et al. | |
| D880,614 | S | 4/2020 | Bernard et al. | |
| D880,615 | S | 4/2020 | Bernard et al. | |
| D881,284 | S | 4/2020 | Glenn et al. | |
| D881,285 | S | 4/2020 | Glenn et al. | |
| D881,995 | S | 4/2020 | Bernard et al. | |
| D882,694 | S | 4/2020 | Glenn et al. | |
| D882,695 | S | 4/2020 | Glenn et al. | |
| D882,696 | S | 4/2020 | Lesley et al. | |
| D882,697 | S | 4/2020 | Lesley et al. | |
| D882,698 | S | 4/2020 | Lesley et al. | |
| D882,699 | S | 4/2020 | Bernard et al. | |
| D882,700 | S | 4/2020 | Wudtke et al. | |
| D883,393 | S | 5/2020 | Bernard et al. | |
| D884,079 | S | 5/2020 | Glenn, II et al. | |
| 2006/0281559 | A1* | 12/2006 | Luciano | G07F 17/32 463/46 |
| 2008/0039213 | A1 | 2/2008 | Cornell et al. | |
| 2015/0087401 | A1* | 3/2015 | Glenn, II | G07F 17/3211 463/25 |
| 2016/0093142 | A1* | 3/2016 | Lamb | G07F 17/3216 463/20 |
| 2018/0075689 | A1* | 3/2018 | Castro | A63F 13/24 |
| 2018/0204416 | A1* | 7/2018 | Perea-Ochoa | G07F 17/3272 |

* cited by examiner

MULTI-TIERED USER INTERFACE FOR A GAMING MACHINE

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2020, SG Gaming, Inc.

FIELD OF THE INVENTION

The present invention relates generally to gaming machines and methods of operating the same and, more particularly, relates to a multi-tiered user interface for operating a gaming machine.

BACKGROUND OF THE INVENTION

The competitive landscape among gaming machine suppliers is fueled by accelerated product life cycles, increased product supply, continued entry of competitors, and increased investment in advanced development resources. To compete in the space of premium gaming machines with more expensive or extravagant components, suppliers have sought to differentiate such gaming machines with unique hardware configurations, game play mechanics, and third-party branded content. Such hardware configurations often include one or more large display devices in a landscape and/or portrait orientation. As display devices have grown larger, the machines have grown taller and/or occupied a larger footprint which, in turn, has compromised player comfort and ergonomics and restricted where such machines can be installed on the casino floor. For example, when sitting in front of a machine with a tall display, the player may experience eyestrain from the display being "in the player's face" or neck strain associated with "looking up" to view the entire display. Further, because the tall machines can block sightlines across a casino floor and impair a player's ability to walk through floor aisles and find a desirable machine to play, such machines may need to be installed against a wall or column, away from mainstream areas of the casino floor. These factors do not support long-term play and casino floor share growth.

A need therefore exists for a premium gaming machine that overcomes one or more of these drawbacks.

SUMMARY OF THE INVENTION

According to an embodiment of the present invention, a gaming machine comprises a cabinet, a display device coupled to the cabinet, a control unit housed within the cabinet, and a multi-tiered user interface coupled to the cabinet. The control unit is configured to direct the display device to display a wagering game. The user interface includes lower and upper tiers disposed at respective lower and upper elevations. The upper tier at least partially overhangs the lower tier. The lower and upper tiers bear respective first and second types of input devices for operating the wagering game.

According to another embodiment of the present invention, a method of operating the gaming machine with the multi-tiered user interface is disclosed herein.

Additional aspects of the invention will be apparent to those of ordinary skill in the art in view of the detailed description of various embodiments, which is made with reference to the drawings, a brief description of which is provided below.

Figure 1A:
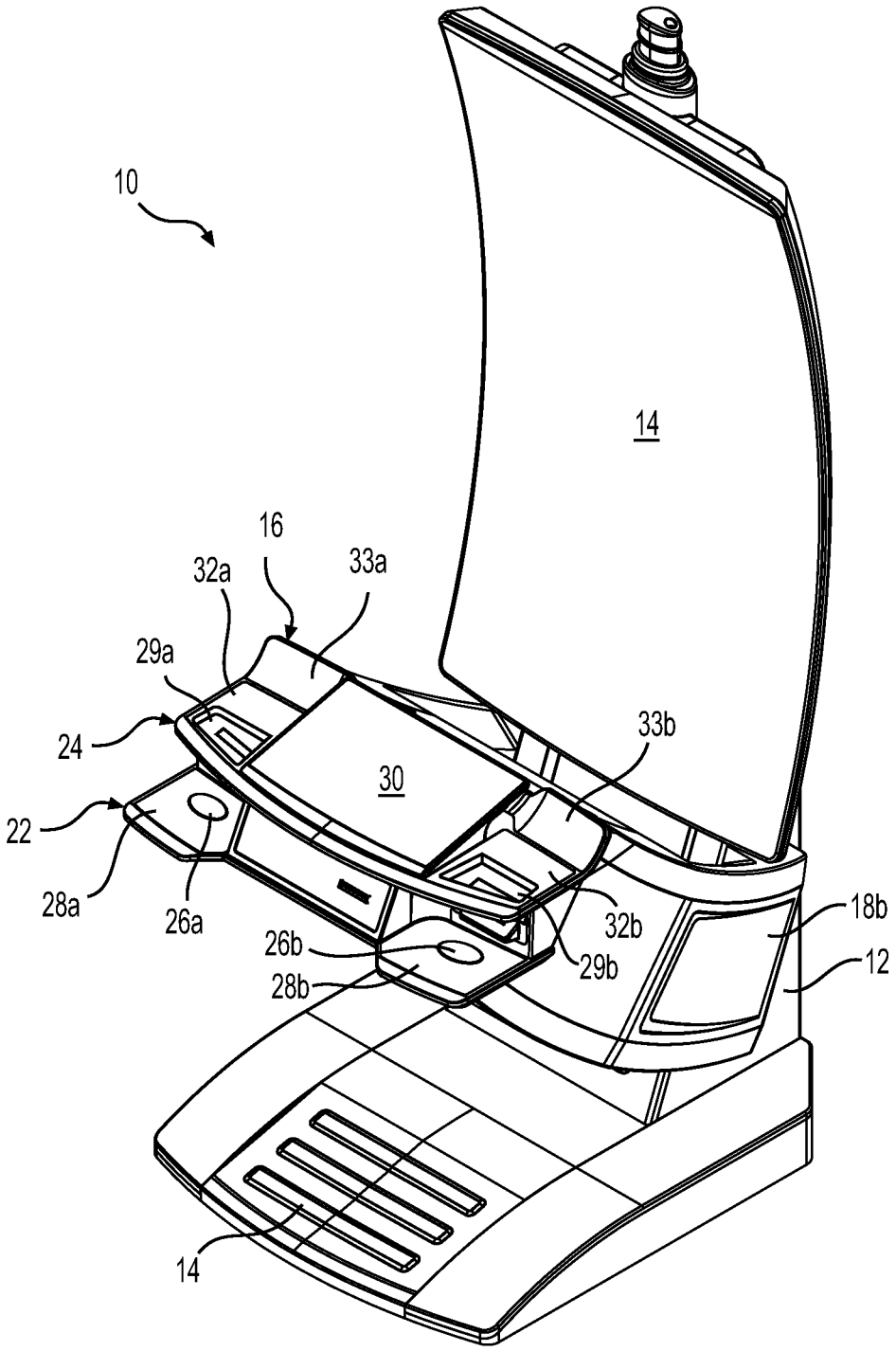
FIGS. 1A and 1B are isometric views of a gaming machine according to an embodiment of the present invention.
Figure 1B:
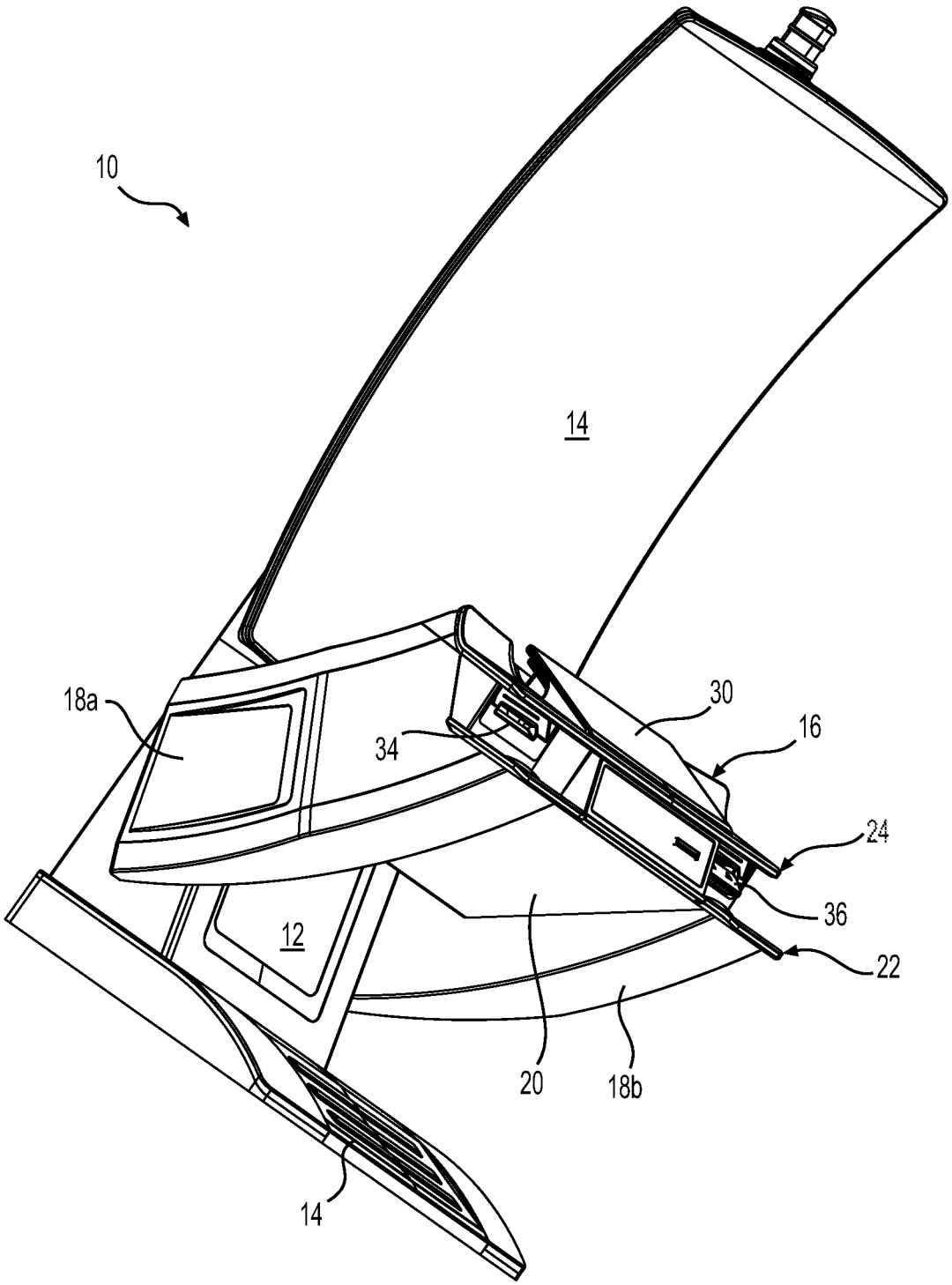

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIGS. 1A, 1B, 2, 3A, 3B, and 4, there is shown a gaming machine 10 according to an embodiment of the present invention. The gaming machine 10 may be an electromechanical gaming terminal configured to play mechanical slots, or a video gaming terminal configured to play a video casino game, such as slots, keno, poker, blackjack, roulette, craps, etc. The gaming machine 10 comprises a base unit 12 and a footrest 14 projecting forward from the base unit 12. The base unit 12 supports a primary display device 14 and optionally a secondary display device (not shown) above the primary display device 14. The base unit 12 may contain auxiliary equipment such as an amplifier and speaker components (e.g., subwoofer). The primary display device 14 is mounted to the base unit 12 by hooks, hinges, latches, fasteners, or the like. The primary display device 14 may be flat, faceted, or curved and may be oriented in a landscape or portrait configuration. In the illustrated embodiment, the primary display device 14 is a 55" LCD or OLED having a concave shape and oriented in a portrait configuration.

Figure 2:
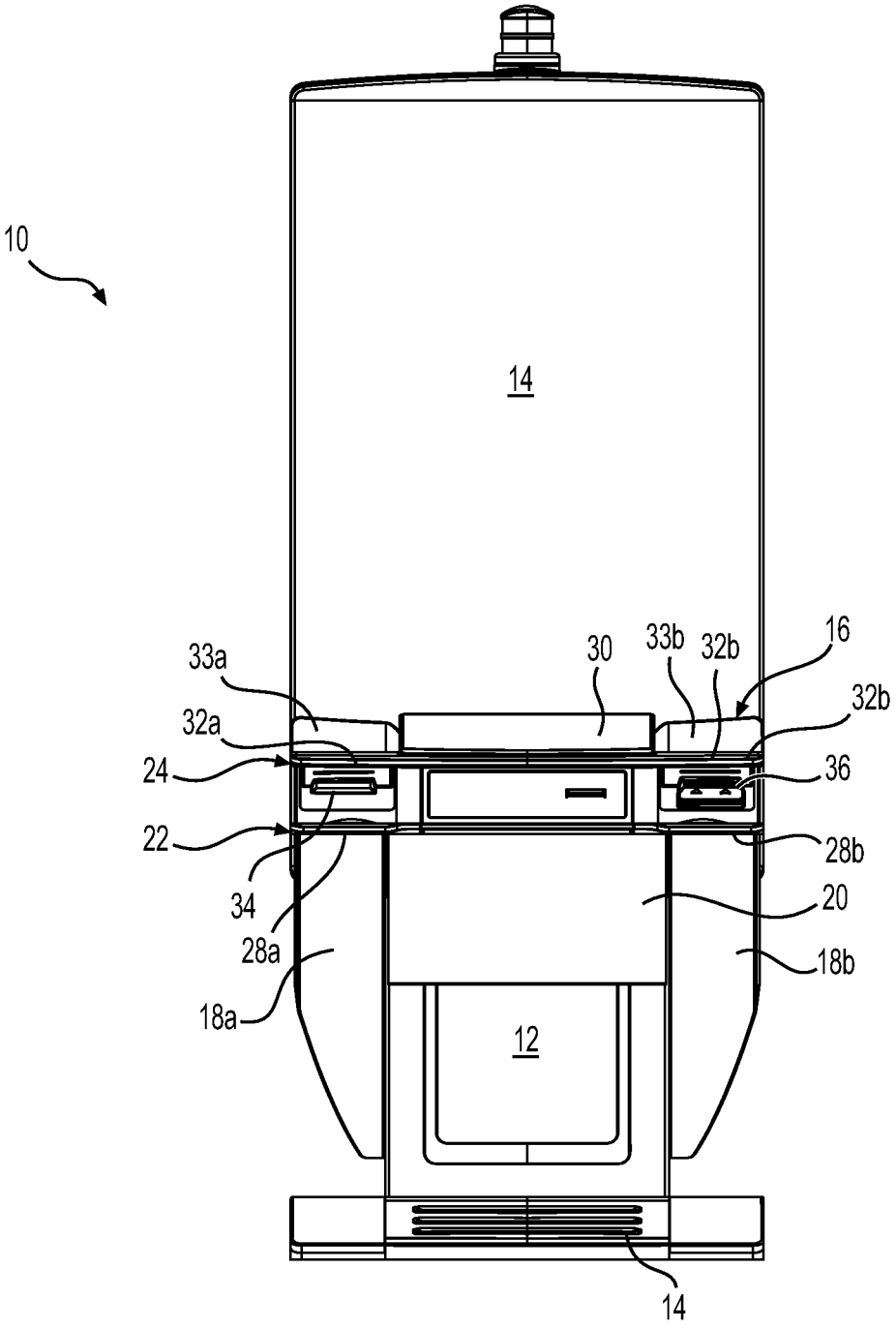
FIG. 2 is a front elevation view of the gaming machine according to an embodiment of the present invention.

The gaming machine 10 further comprises a multi-tiered user interface 16 mounted to the base unit 12 by a pair of opposing arms 18*a* and 18*b*. The arms 18*a* and 18*b* are connected to the user interface 16 at one end and the base unit 12 at the other end by hooks, hinges, latches, fasteners, or the like. The left arm 18*a* contains a first peripheral device such as a ticket dispenser (not shown). The right arm 18*b* contains a second peripheral device such as a bill acceptor/validator (not shown). As shown in FIG. 2, a CPU box 20 is mounted beneath the user interface 16 and bridges the opposing arms 18*a* and 18*b*. The CPU box 20 contains a central processing unit (CPU), aka control unit (not shown), for operating the gaming machine 10, executing a wagering game played via the gaming machine 10, and directing the primary display device 14 to display the wagering game. The CPU may include any suitable processor(s) and controllers (and associated memory) such as those made by Intel and AMD and may include a master processor, a slave processor, and a secondary or parallel processor. The CPU is connected to the first and second peripheral devices, the auxiliary equipment, and the primary display device 14 by cables/wires running between the CPU box 20 on the one hand and the base unit 12 and the arms 18*a* and 18*b* on the other hand. The exterior walls of the base unit 12, the arms 18*a* and 18*b*, and the CPU box 20 may be composed of sheet metal, cast metal, rigid plastic, or the like and may contain one or more doors that are locked and require a physical or electronic key to gain access to an interior thereof.

Referring to FIGS. 2, 3A, 3B, and 5, the multi-tiered user interface 16 is disposed at an elevation that is higher than a lower edge of the primary display device 14 such that the user interface 16 is in front of the primary display device 14. The user interface 16 comprises a lower tier 22 and an upper tier 24 disposed at respective lower and upper elevations.

The lower tier 22 bears a first type of input device for operating a wagering game via the gaming machine. The first type of input device may be a pair of round or oval push buttons 26*a* and 26*b* on respective left and right flat surfaces 28*a* and 28*b* of the lower tier 22. In response to a user pressing either push button 26*a* or 26*b*, the CPU may conduct a first action associated with the wagering game. If the push buttons 26*a* and 26*b* are "spin" or "play" buttons, the first action may be to initiate the wagering game.

The upper tier 24 is generally parallel to, and partially overhangs, the lower tier 22. The upper tier 24 bears a second type of input device for operating the wagering game via the gaming machine. The second type of input device may be a touchscreen video display 30 mounted to a center section of the upper tier 24. The video display 30 may be flat, faceted, or curved and may be oriented in a landscape or portrait configuration. In the illustrated embodiment, the video display 30 is a 15.6" LCD or OLED having a concave shape and oriented in a landscape configuration. The video display 30 may display credit meters, selected game options, and game play features. In response to the user pressing touch keys on the video display 30, the CPU may conduct one or more second actions associated with the wagering game. For example, the second actions may be to select a denomination, select a wager amount, select a number of pay lines, initiate the wagering game (as an alternative to pressing the push buttons 26*a* and 26*b*), request a service attendant, cash out or collect credits on a credit meter, adjust the audio volume, or open help/pays/game rules screens. The upper tier 24 also includes left and right flat surfaces 32*a* and 32*b* on opposite sides of the video display 30. The left surface 32*a* serves as a charging pad for charging a mobile device and bears a charging infographic/icon to indicate this functionality to the user. The right surface 32*b* serves as a beverage support and bears a drink infographic/icon to indicate this functionality to the user. Left and right speakers 33*a* and 33*b* extend upwardly from the rear edges of the respective left and right surfaces 32*a* and 32*b*.

As described above, the left arm 18*a* contains a first peripheral device such as a ticket dispenser, and the right arm 18*b* contains a second peripheral device such as a bill acceptor. An exit slot 34 of the ticket dispenser is disposed behind the push button 26*a* between the lower tier 22 and the upper tier 24. An entry slot 36 of the bill acceptor is disposed behind the push button 26*b* between the lower tier 22 and the upper tier 24. A player tracking module 38 is mounted to a center section of the lower tier 24 and disposed between the lower tier 22 and the upper tier 24. Front portions 29*a* and 29*b* of the respective surfaces 32*a* and 32*b* are transparent or transmissive to enable a player to view the respective exit slot 34 and entry slot 36 (and illuminated visual cues like directional arrows associated therewith) from above through the respective front portions 29*a* and 29*b*. The visual cues provide valuable indications so that ticket retrieval from the exit slot 34 and cash entry into the entry slot 36 are as low friction as comparable gaming machines.

The multi-tiered user interface 16 may be configured to accommodate devices in addition to those described herein, including but not limited to additional push buttons, an additional video display, a mouse, a joystick, a trackball, a gesture-sensing device, and a voice-recognition device.

Figure 3A:
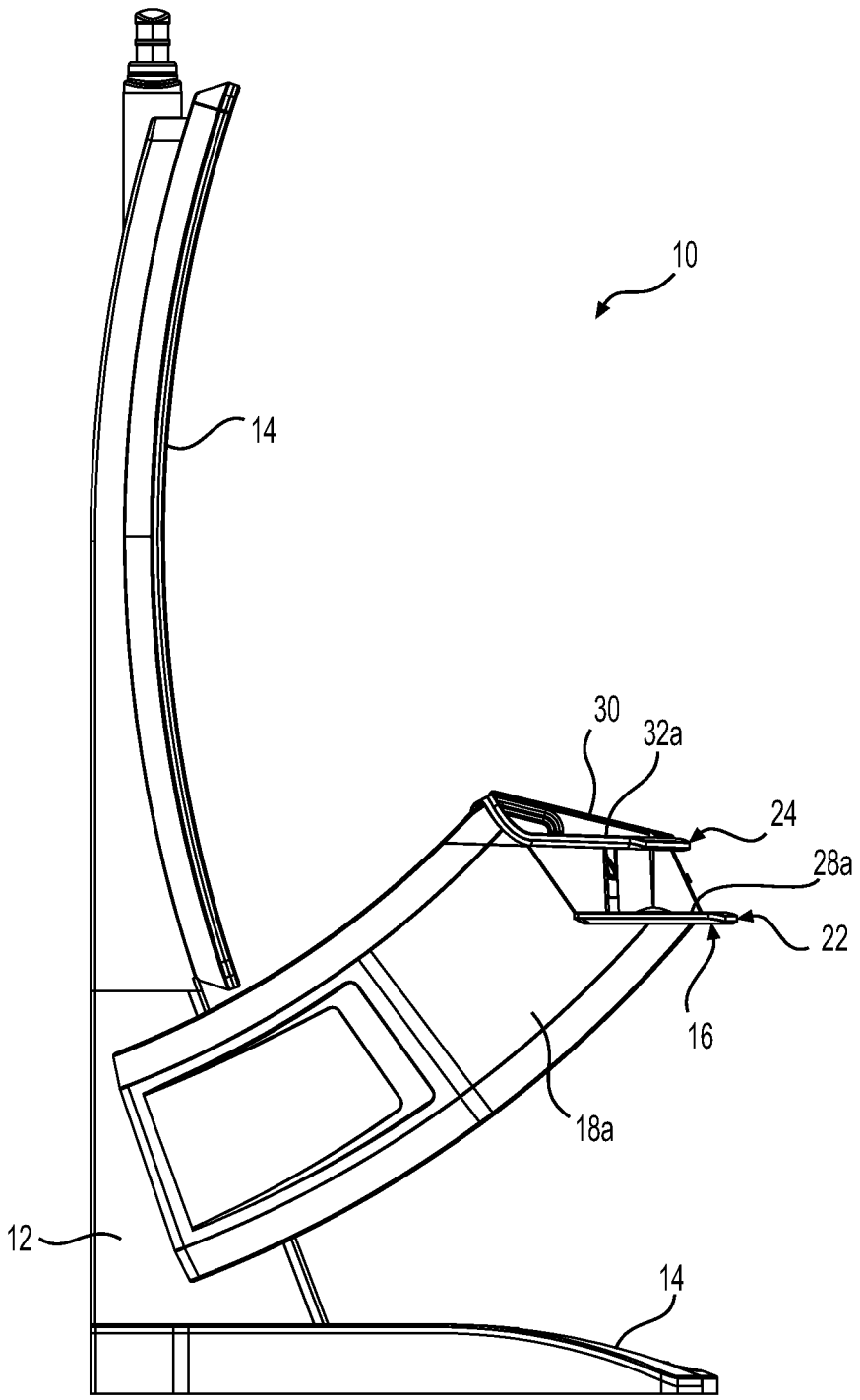
FIGS. 3A and 3B are left and right side elevation views of the gaming machine according to an embodiment of the present invention.
Figure 3B:
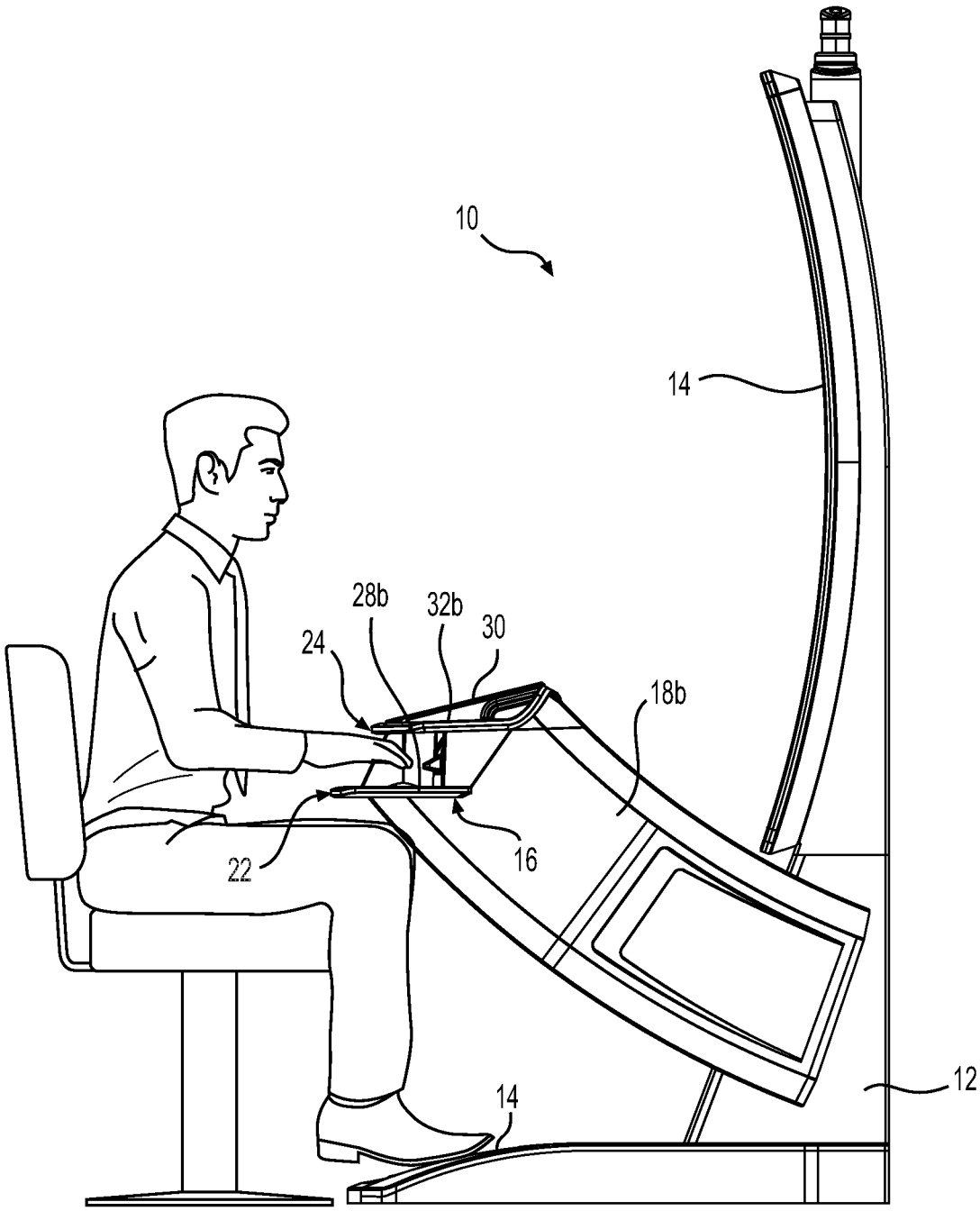
Figure 4:
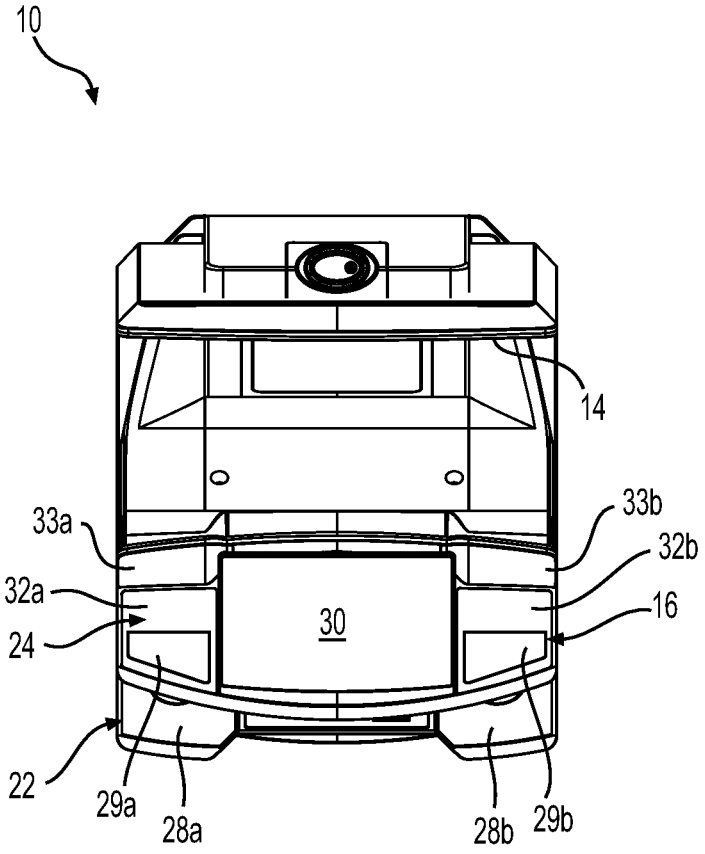
FIG. 4 is a top view of the gaming machine according to an embodiment of the present invention.
Figure 5:
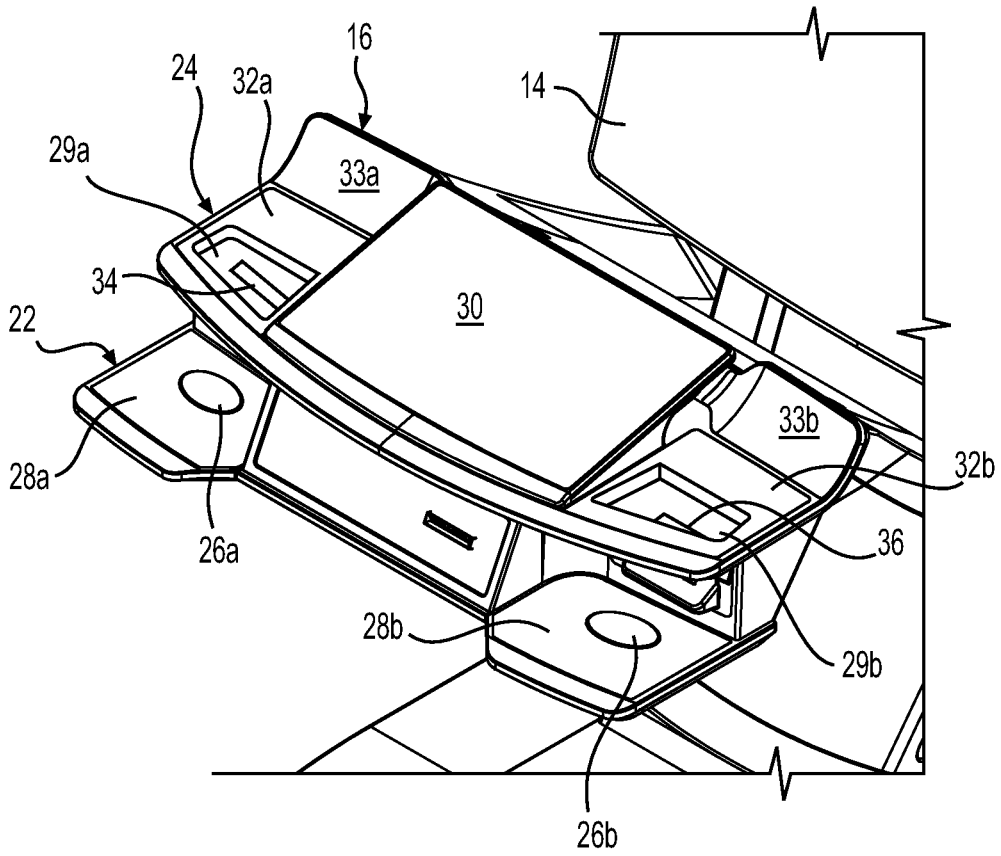
FIG. 5 is a close-up isometric view of the multi-tiered user interface of the gaming machine according to an embodiment of the present invention.

The multi-tiered user interface 16 of the gaming machine 10 offers a superior level of interaction, comfort, and convenience in an aesthetically attractive package. The user interface 16 provides superior ergonomics, visibility, and usability that works with, not against, player anatomy and physical limitations. For example, when an average height player is seated in front of the gaming machine 10 as shown in FIG. 3B and repeatedly presses push button 26*a* or 26*b* to initiate the wagering game, the lower tier 22 bearing those push buttons 26*a* and 26*b* is positioned at an elevation that allows a bent arm of the player to be at a near resting position and does not require the player to lift or reach to a higher elevation, thereby providing maximum comfort. Furthermore, the user interface 16 is (i) decoupled and horizontally offset from the primary display device 14 and (ii) disposed at a higher elevation than a lower edge of the primary display device 14, such that (a) the primary display device 14 has an overall height that is generally less than height of other gaming machines with similarly sized primary displays and (b) the player can still view the lower portion of the primary display device 14 when seated in front of the gaming machine 10. This positioning of the user interface 16 relative to the primary display device 14 enables a player to view the primary display device 14 without the primary display device 14 being "in the player's face," thereby reducing eyestrain. And placing the player's viewpoint towards a center portion (relative to the upper and lower edges) of the primary display device 14 reduces neck strain associated with "looking up" to view the entire primary display device 14; a particularly valuable feature with an aging demographic. Because the gaming machine 10 is generally shorter and more compact than other gaming machines with similarly sized primary displays, the gaming machine 10 is less imposing, more approachable, and subject to less restrictions as to where it can be installed on the casino floor. These factors support long-term play and casino floor share growth.

The gaming machine 10, including but not limited to the multi-tiered user interface 16, the primary display device 14, and their relative positioning, may use alternative designs to achieve the same functionality described herein. For example, while maintaining lower and upper tiers 22 and 24, the shapes of the edges and surfaces of those tiers may be varied from what is illustrated in the drawings. And the shapes, locations, quantities, and types of components on and between the tiers may be varied from what is illustrated in the drawings.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming machine comprising:

a cabinet, a display device coupled to the cabinet;

a control unit housed within the cabinet and configured to direct the display device to display a wagering game; and a user interface coupled to the cabinet and including lower and upper tiers disposed at respective lower and upper elevations, the upper tier at least partially overhanging the lower tier, the lower and upper tiers bearing respective first and second types of input devices for operating the wagering game, the lower and upper tiers including respective lower and upper flat panels, the upper flat panel including a transparent or transmissive portion through which a user can view a slot associated with a peripheral device and covered by the upper flat panel, the slot being disposed between the lower and upper tiers.

2. The gaming machine of claim 1, wherein the user interface is disposed in front of the display device.

3. The gaming machine of claim 1, wherein the first type of input device is one or more push buttons, and wherein the second type of input device is a video display with touchscreen.

4. The gaming machine of claim 3, wherein the upper tier bears a charging pad adjacent to the video display.

5. The gaming machine of claim 3, wherein the one or more push buttons include first and second push buttons, and wherein the user interface includes a bill acceptor and a ticket dispenser disposed between the lower and upper tiers, the bill acceptor being disposed behind the first push button, the ticket dispenser being disposed behind the second push button.

6. The gaming machine of claim 1, wherein the peripheral device is selected from a group consisting of a bill acceptor, a ticket dispenser, and a player tracking unit.

7. A user interface for a gaming machine, the gaming machine including a cabinet, a display device coupled to the cabinet, and a control unit housed within the cabinet, the user interface comprising:

a lower tier disposed at a lower elevation, the lower tier bearing a first type of input device for operating a wagering game via the gaming machine; and an upper tier disposed at an upper elevation and at least partially overhanging the lower tier, the upper tier bearing a second type of input device for operating the wagering game via the gaming machine;

wherein the lower and upper tiers include respective lower and upper flat panels, the upper flat panel including a transparent or transmissive portion through which a user can view a slot associated with a peripheral device and covered by the upper flat panel, the slot being disposed between the lower and upper tiers.

8. The user interface of claim 7, wherein the user interface is disposed in front of the display device.

9. The user interface of claim 7, wherein the first type of input device is one or more push buttons, and wherein the second type of input device is a video display with touchscreen.

10. The user interface of claim 9, wherein the upper tier bears a charging pad adjacent to the video display.

11. The user interface of claim 9, wherein the one or more push buttons include first and second push buttons, and further including a bill acceptor and a ticket dispenser disposed between the lower and upper tiers, the bill acceptor being disposed behind the first push button, the ticket dispenser being disposed behind the second push button.

12. The user interface of claim 7, wherein the peripheral device is selected from a group consisting of a bill acceptor, a ticket dispenser, and a player tracking unit.

13. A method of operating gaming machine, the gaming machine including a cabinet, a display device coupled to the cabinet, a control unit housed within the cabinet, and a user interface coupled to the cabinet, the user interface including lower and upper tiers disposed at respective lower and upper elevations, the upper tier at least partially overhanging the lower tier, the lower and upper tiers including respective lower and upper flat panels, the upper flat panel including a transparent or transmissive portion through which a user can view a slot associated with a peripheral device and covered by the upper flat panel, the slot being disposed between the lower and upper tiers, the method comprising:

directing, by the control unit, the display device to display a wagering game;

in response to a user operating a first type of input device supported by the lower tier, conducting, by the control unit, a first action associated with the wagering game; and in response to the user operating a second type of input device supported by the upper tier, conducting, by the control unit, a second action associated with the wagering game.

14. The method of claim 13, wherein the user interface is disposed in front of the display device.

15. The method of claim 13, wherein the first type of input device is one or more push buttons, wherein the second type of input device is a video display with touchscreen, and wherein the first action is initiating the wagering game.

16. The method of claim 15, wherein the upper tier bears a charging pad adjacent to the video display, and further including charging a mobile device placed on the charging pad.

17. The method of claim 15, wherein the one or more push buttons include first and second push buttons, wherein the user interface includes a bill acceptor and a ticket dispenser disposed between the lower and upper tiers, the bill acceptor being disposed behind the first push button, the ticket dispenser being disposed behind the second push button, and further including receiving a bill or ticket in the bill acceptor to fund the wagering game and dispensing a ticketing from the ticket dispenser to cash out from the wagering game.

18. The method of claim 13, wherein the user interface includes a bill acceptor, a ticket dispenser, and a player tracking unit disposed between the lower and upper tiers, and further including receiving a bill or ticket in the bill acceptor to fund the wagering game and dispensing a ticket from the ticket dispenser to cash out from the wagering game.

* * * * *